United States Patent [19]

Rappinger et al.

[11] Patent Number: 4,701,931

[45] Date of Patent: Oct. 20, 1987

[54] ELECTRICALLY CONDUCTIVE BRICKS

[75] Inventors: Bo Rappinger; Sven-Einar Stenkvist, both of Västerås, Sweden

[73] Assignee: ASEA AB, Västerås, Sweden

[21] Appl. No.: 936,810

[22] Filed: Dec. 2, 1986

[30] Foreign Application Priority Data

Dec. 2, 1985 [SE] Sweden ..... 8505659

[51] Int. Cl.[4] ..... F27D 1/004

[52] U.S. Cl. ..... 373/72

[58] Field of Search ..... 373/72, 73, 74, 75, 373/76, 137, 164; 432/252, 248; 110/338, 339, 340; 52/606

[56] References Cited

U.S. PATENT DOCUMENTS

| | | | |
|---|---|---|---|
| 122,908 | 1/1872 | Perry | 110/338 |
| 1,775,396 | 9/1930 | Jackman et al. | 110/338 |
| 2,154,414 | 4/1939 | Teeters | 110/338 |
| 4,101,725 | 7/1978 | Shelepov et al. | 373/72 |
| 4,435,813 | 3/1984 | Stenkvist | 373/72 |
| 4,532,633 | 7/1985 | Stenkvist | 373/72 |

*Primary Examiner*—Roy N. Envall, Jr.

*Attorney, Agent, or Firm*—Kenyon & Kenyon

[57] ABSTRACT

Electrically conductive refractory bricks, containing particles (e.g. flakes) of graphite or other electrically conductive material are pressed into the desired final shape but include a plurality of passages, none of which passes completely through the brick. The passages each extend substantially perpendicularly to the predominant direction of the conducting particles.

6 Claims, 2 Drawing Figures

ELECTRICALLY CONDUCTIVE BRICKS

TECHNICAL FIELD

The present invention relates to an electrically conductive brick containing, as a component of its constituent material, graphite or other electrically conductive elongate particles (e.g. in the form of flakes), the bricks being formed by pressing the constituent materials into the desired final shape.

PRIOR ART

In d.c. arc furnaces electrically conductive refractory bricks are often included in the hearth connection (the bottom electrode of the furnace). These bricks often contain a refractory oxide material inter-mixed with graphite flakes. The oxide material may consist of magnesium or aluminum oxides or oxides of silicon or zirconium. One problem in connection with such bricks is how to provide adequate thermal insulation while at the same time maintaining good electrical conductivity. In solving these problems it has been necessary to make the thickness of the bottom electrode greater than would otherwise be desirable. Directional electrical conductors in the form of graphite flakes at the same time constitute directional thermal conductors.

Similar problems exist for other arc furnaces in which conductive refractory bricks are required, or for ladle furnaces, for example d.c. ladle furnaces.

SUMMARY OF THE INVENTION

The invention aims to provide a solution to the above-mentioned problems and other problems associated therewith and is characterized in that a plurality of passages each having a longitudinal direction—which passages do not pass completely through the brick—are arranged in the brick, the longitudinal direction of each passage extending substantially perpendicularly to the predominant elongate direction of the conductive particles. Thus, in the pressing of the bricks, a certain alignment of the conductive particles is obtained. The passages provide good heat insulation but do not prevent the flow of electric current normal to their longitudinal directions to any significant extent. For strength reasons, the passages are not made to be through passages, but they do provide good thermal insulation against the heat flowing outwards from the furnace. The invention can thus be seen to be the manufacture of electrically conductive bricks, in which a directional porosity is provided perpendicular to the direction to which the graphite flakes or other conductive particles conform during the pressing operation, by using a special form of the press mold. In this way, a reduced thermal conductivity is obtained in a refractory brick without significantly reducing the electrical conductivity of the brick.

Increasing the porosity results in improved heat insulating properties. By directing the porosity in the manner described, hollow bricks of the type used in the building industry are obtained, the thermal insulating capacity of the bricks being increased. However, a layer structure must be obtained in the brick in which, for electrical reasons, the layers must be electrically interconnected. Therefore, the passages should each be made horizontally flat and oriented in the furnace bottom so that their longitudinal extension becomes perpendicular to the direction of the conductive particles. As already mentioned, for reasons of strength as well as convenience in molding techniques, the passages should not pass through the brick. The greatest compressive stresses are expansion forces in the lateral direction and not the ferro-static pressure. Non-continuous passages and a small total hollow sectional surface should be dimensioned such that the bricks are capable of withstanding the anticipated lateral pressure.

The convection which arises in the passages will be small because only small temperature differences exist within the passages. The surfaces of the passages may possibly be coated with a dark color or with a ceramic surface layer which has a low emission coefficient, to reduce the radiation from one wall of a passage to the opposite wall of the passage. The passages are oriented such that the running in of melt takes place only parallel to the boundary between the bottom lining and the melt.

BRIEF DESCRIPTION OF THE DRAWING

The invention will be further described, by way of example, with reference to the accompanying drawing, in which.

DESCRIPTION OF PREFERRED EMBODIMENTS

Figure 1:
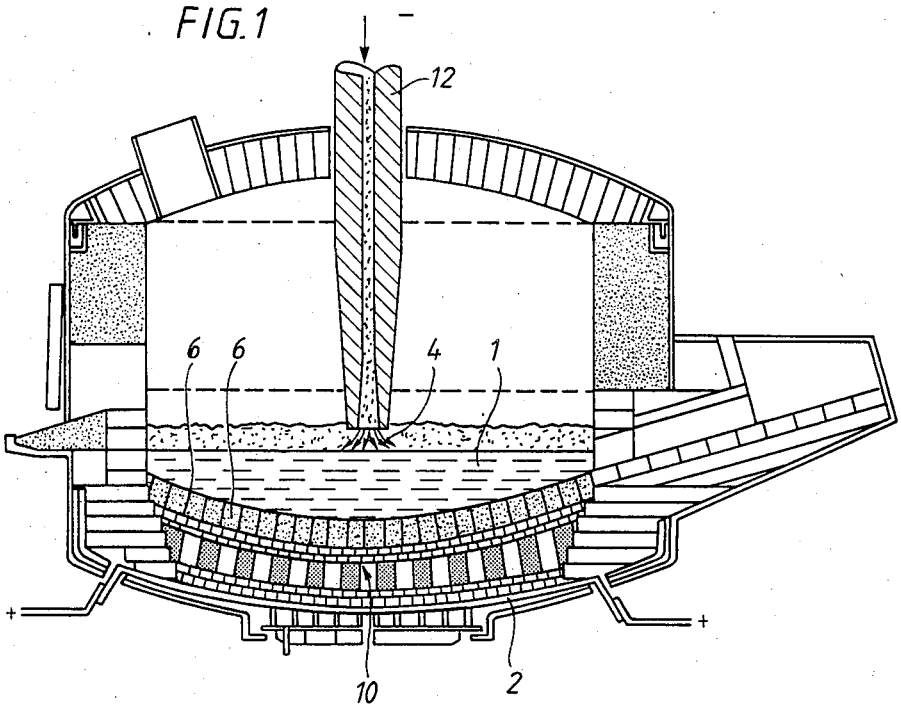
FIG. 1 shows, in vertical section, part of a hearth connection or bottom electrode of a d.c. furnace, in which a certain layer consists of electrically conducting refractory bricks.

FIG. 1 shows part of a d.c. arc furnace containing molten metal 1 resting on a conducting bottom wall 10 of the furnace. In operation of the furnace, current 4 flows between the positive hollow electrode 12 and a hearth electrode 2 positioned below the wall 10. The bottom wall 10 of the arc furnace is made up of several layers, the uppermost of which consists of a plurality of closely packed electrically conducting refractory bricks 6. The molten metal being processed in the furnace will rest on the upper surfaces of the bricks 6 and electric current will flow vertically through these bricks between the heart connection electrode (shown schematically at 2 in FIG. 2) and the melt 1 resting on the wall 10.

Figure 2:
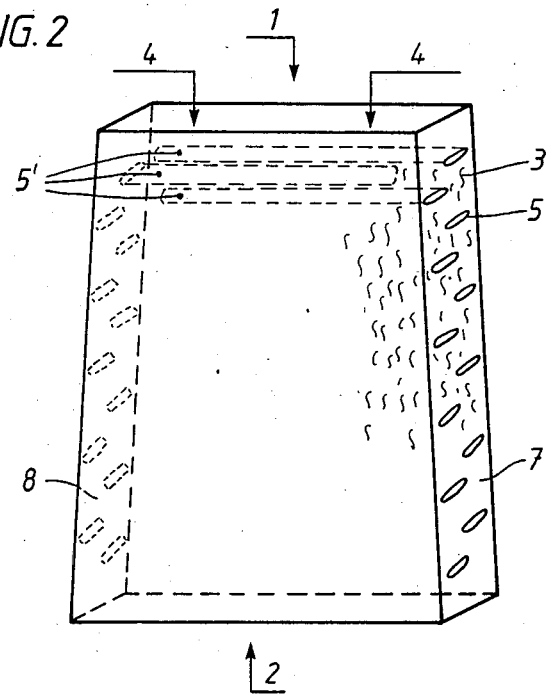
FIG. 2 shows a single electrically conducting refractory brick according to the invention such as is used in the furnace of FIG. 1.

Each brick 6 is made by compressing a mixture of elongated electrically conducting particles 3 and an inert refractory filler material in a mold which molds longitudinal passages in the brick and one such brick is shown on an enlarged scale in FIG. 2.

The brick shown in FIG. 2 has been pressed in the horizontal direction and this aligns the particles 3 so that their elongated direction extends vertically as shown. The particles 3 can be graphite flakes which, because of their packing density in the brick and their vertical alignment serve to allow current flow between the hearth connection 2 and the melt 1. The current flow is represented by the arrows 4 in FIG. 2.

Blind passages 5 are provided across the brick 6, these passages extending in from two opposite sides 7 and 8 of the brick, but each passage extends only partly across the direction of the current flow 4. Each passage is formed with a narrow section, for example oval or rectangular, the longer cross-sectional dimension being disposed perpendicular to the elongated direction of the flakes. The three upper passages in the brick have been shown in dashed lines 5. However, the other passages are of a similar kind, and as will be seen the passages are disposed in a staggered or zigzag configuration such that the current is able to find its way between these passages along the flakes from the upper (hot) side to the lower (cold) side, that is, to the hearth connection 2. The orientation of the flakes 3 can be obtained naturally by the flakes being oriented at right angles to the pressing direction during the pressing operation. The passages are disposed perpendicular to this direction of the flakes. In FIG. 2, the passages extend through at least half the width of the brick; however, different lengths—both shorter and longer—may also be used. As shown the passages are all non-circular in cross-section, for example oval, having their longer side perpendicular to the direction of the flakes. The bricks can be arranged in the hearth connection in a d.c. arc furnace, or in the bottom or other wall of an arc furnace in which electrically conducting refractory bricks are required, or in d.c. ladle furnaces. The filler material adjacent to the conductive particles may be composed of a normal oxidic material such as magnesium or aluminum oxides, or silicon oxide, zirconium oxide or other similar refractory oxides.

The graphite flakes can be replaced by or supplemented with shavings of an electrically conductive metal.

The means according to the above can be varied in many ways within the scope of the following claims.

What is claimed is:

1. An electrically conductive brick containing a refractory filler material and electrically conductive elongate particles, the bricks being formed by pressing the filler material and conductive particles into a desired shape for the brick, wherein a plurality of passages each having a longitudinal direction and none of which pass completely through the brick, are arranged in the brick, each said passage extending in its longitudinal direction substantially perpendicular to the elongate direction of the conductive particles.

2. A brick according to claim 1, in which the conductive particles are graphite flakes.

3. A brick according to claim 1, in which each passage is of non-circular cross-section having two wider sides, the wider sides being disposed substantially perpendicular to the elongate direction of the conductive particles.

4. A brick according to claim 2, in which each passage is of non-circular cross-section having two wider sides, the wider sides being disposed substantially perpendicular to the elongate direction of the flakes.

5. A brick according to claim 1, arranged with other smaller bricks to form an electrically conductive wall of a melt-containing furnace.

6. Bricks according to claim 5, in which the bricks form part of the bottom electrode of a d.c. arc furnace and overlie a hearth electrode of the furnace.

* * * * *